US007857543B2

(12) United States Patent
Tröster

(10) Patent No.: US 7,857,543 B2
(45) Date of Patent: Dec. 28, 2010

(54) TRAFFIC INSTALLATION

(76) Inventor: Günther Tröster, Tannenweg 6, 96149 Breitengüssbach (DE)

( * ) Notice: Subject to any disclaimer, the term of this patent is extended or adjusted under 35 U.S.C. 154(b) by 95 days.

(21) Appl. No.: 12/375,902

(22) PCT Filed: Aug. 7, 2006

(86) PCT No.: PCT/DE2006/001386

§ 371 (c)(1),
(2), (4) Date: Mar. 27, 2009

(87) PCT Pub. No.: WO2008/017279

PCT Pub. Date: Feb. 14, 2008

(65) Prior Publication Data

US 2009/0317184 A1 Dec. 24, 2009

(51) Int. Cl.
*G01M 9/02* (2006.01)
*E01D 15/12* (2006.01)

(52) U.S. Cl. ..... 404/1; 404/71; 14/2; 14/3; 14/78

(58) Field of Classification Search ..... 14/2, 14/3, 78; 404/1, 71
See application file for complete search history.

(56) References Cited

U.S. PATENT DOCUMENTS 3,301,146 A * 1/1967 Kurg et al. ..... 404/1
4,644,978 A * 2/1987 Bonasso ..... 138/157
4,945,594 A 8/1990 Tomb
5,655,244 A * 8/1997 Minakami et al. ..... 14/78
5,846,020 A * 12/1998 McKeown ..... 404/1
6,561,727 B1 * 5/2003 Gustafson, Jr. ..... 404/1
6,668,729 B1 * 12/2003 Richards ..... 104/124
6,676,330 B2 * 1/2004 Stamm et al. ..... 404/1
2003/0091394 A1 5/2003 Ide
2010/0139016 A1 * 6/2010 Miettinen ..... 14/77.1

FOREIGN PATENT DOCUMENTS

DE 2321264 A1 11/1973
DE 4231832 A1 2/1994
FR 2557170 A2 6/1985
GB 989632 4/1965
GB 2394486 A 4/2004
WO WO9844237 A1 10/1998
WO WO2006052041 A1 5/2006

* cited by examiner

*Primary Examiner*—Raymond W Addie
(74) *Attorney, Agent, or Firm*—Workman Nydegger

(57) ABSTRACT

The invention relates to a traffic installation having at least two traffic routes arranged one above the other, which each comprise at least one traffic area, which traffic area is completely enclosed at least over a certain length, the enclosure having at least one transparent element allowing a view out of the enclosure.

19 Claims, 5 Drawing Sheets

TRAFFIC INSTALLATION

BACKGROUND OF THE INVENTION

1. Field of the Invention

The invention relates to a traffic installation, having at least two traffic routes arranged one above the other, which each comprise at least one traffic area.

2. Background and Relevant Art

A traffic installation with at least two traffic routes arranged one above the other comprises, for example, two roads arranged one above the other, for example in the case of a bridge, with at least two traffic areas in the form of roadways being arranged one above the other. It is also possible, however, for traffic routes with rails or other guiding and transporting systems to be arranged one above the other. Apart from guardrails, the roadways are generally open at the edges of the roadway, which has the disadvantage that noise and exhaust caused by vehicles traveling on the roadways can be emitted unhindered directly into the surroundings and the roadways themselves are constantly exposed to atmospheric influences. In built-up areas and towns or cities in particular, the noise and exhaust from vehicles represent a not inconsiderable burden on humans and animals.

In the case of traffic routes for rail-bound vehicles, in particular trains, as well as in the case of traffic routes for automobiles, in particular freeways, protection from noise is provided at least for residents near a traffic route by so-called noise barrier walls on both sides of a traffic route, but they usually have the disadvantage that they do not allow a view from the traffic route out into the area surrounding the traffic route. Travelers, whether passengers on a train or road users in a car, with a claustrophobic disposition may therefore find when they are on the traffic routes that, in the same way as in a tunnel, they develop feelings of being confined or even states of anxiety or fear.

BRIEF SUMMARY OF THE INVENTION

The invention is therefore based on the object of designing a traffic installation of the type mentioned at the beginning in such a way that it can be better adapted as well as possible to the needs of travelers and/or nearby residents.

According to the invention, this object is achieved by a traffic installation having at least two traffic routes arranged one above the other, which each comprises at least one traffic area, which may for example also have a number of lanes, which traffic area is completely enclosed at least over a certain length, the enclosure having at least one transparent element allowing a view out of the enclosure. It is therefore proposed to arrange two traffic routes one above the other, whereby a space-saving, environmentally friendly way of handling traffic can be realized, since the traffic routes are not arranged next to one another, requiring considerable space, but one above the other in a space-saving manner. This is relevant not only to built-up areas and towns or cities, in which there is in any case little space available, but also with a view to a reduced surface area requirement for traffic routes in general, whereby the progressive urban development of land can be reduced. The traffic area, for example a single-lane roadway, may have emergency, breakdown or escape bays.

Furthermore, the preferably simultaneous enclosure of the traffic areas over at least a certain length produces the advantage that no uncontrolled emission of noise and exhaust into the surroundings of the traffic installation can take place. This creates the preconditions, for example, for filtering exhaust gases before they are emitted into the surroundings. The at least partial enclosure of the traffic areas of the traffic routes means that they are protected from external atmospheric effects such as strong heat, rain, ice and snow, also allowing other surfacings and/or rails than before to be used. The enclosure of the traffic areas can, in particular, reduce the risk of accidents relating to rain, ice and snow. Furthermore, savings are obtained, for example on services provided during winter, which are virtually unnecessary, or necessary only to a limited extent, for enclosed traffic areas. The traffic areas themselves are subjected to less weather-dependent corrosion as a result of the enclosure, with the result that expenditure on upkeep of the traffic areas can be reduced. The expenditure concerned includes not only the lower costs for repair work to the traffic areas but also the lower operating costs of the equipment and vehicles required for maintaining and preserving the traffic areas. The upkeep of such a traffic installation is consequently more cost-effective.

A further advantage of the traffic installation according to the invention is the at least one transparent element allowing a view out of the enclosure, since the visual link with the outside, that is to say out of the enclosure, advantageously allows users of the traffic installation, whether passengers or drivers, to avoid feelings of being confined or states of anxiety or fear. The enclosure generally has a number of transparent elements, which preferably extend along the entire enclosure, to be precise with preference on both sides of the traffic area of a traffic route. The element or elements are in this case transparent in such a way that structures and objects outside the enclosure are at least roughly recognizable in terms of outlines and/or colors. With preference, a transparent element allows a clear view through the element, as is the case with a clear sheet of plastic or glass. The element may be toned and/or tinted, for example to protect against strong sunlight.

According to one variant of the invention, the transparent element or elements are arranged in such a way that the transparent element or elements allow a view through the element at least at the viewing height of a traveler using the traffic area. Depending on how the traffic area is used, the transparent elements are therefore arranged in such a way that a traveler has, as far as possible, an unrestricted view out of the enclosure to the outside at his or her viewing height or eye level.

According to one embodiment of the invention, in the traffic installation a traffic route is intended for an automobile and/or for a two-wheeled vehicle and/or a pedestrian and/or for a rail-bound vehicle. In this respect, there are an extremely wide range of possibilities for combining traffic routes in the traffic installation. For example, two traffic routes intended for automobiles may be arranged one above the other and a traffic route intended for automobiles and two-wheeled vehicles may be arranged above a traffic route intended for rail-bound vehicles.

In particular to keep the ground area requirement for the traffic installation as small as possible, the traffic routes of the traffic installation are arranged, at least over a certain length, such that they follow the same path, vertically one above the other, on different levels.

According to variants of the invention, the traffic installation comprises a supporting structure for the traffic routes arranged one above the other, which preferably comprises concrete, for example reinforced concrete and/or a three-dimensional framework. There is therefore the possibility of fabricating the supporting structure for example from reinforced concrete or a three-dimensional framework or else a combination of reinforced concrete and a three-dimensional framework. The three-dimensional framework in this case comprises tubes or rods and connecting elements for the tubes or rods, the tubes or rods generally being formed from steel and pointed at the ends, in order to connect them to one another, in particular using spherical connecting elements, to form static structures. Such three-dimensional frameworks are, for example, manufactured and erected by the company MERO-TSK INTERNATIONAL GMBH & CO. KG, based in Würzburg, Germany, which uses, for example, steel tubes and so-called MERO nodes as connecting elements, which preset certain angles in the structure. Alternative materials that may be used are aluminum, GRP (glass fiber reinforced plastic) and/or CRP (carbon fiber reinforced plastic), as well as other plastics.

According to variants of the invention, there is the possibility of the supporting structure having at least one supporting pier, preferably however a number of supporting piers, which at least partially accept the traffic routes. However, there is also the possibility of the supporting structure being formed in such a way that it not only supports a traffic route but completely encloses at least one traffic area of a traffic route, at least over a certain length. In this case, therefore, a traffic area is enclosed by the supporting structure. The traffic installation may in this case be designed in such a way that only one traffic area of one traffic route is completely enclosed by the supporting structure over a certain length or else that all the traffic areas or all the traffic routes of the traffic installation are completely enclosed by the supporting structure.

In particular if the supporting structure encloses a traffic route or a traffic area, one embodiment of the invention provides that the transparent element is formed like a window or like a noise barrier window and is fitted into the supporting structure like a window or a noise barrier window, a traffic route comprising at least one window-like or noise barrier window-like element, with preference a number of window-like or noise barrier window-like elements extending along the traffic route, at least at the viewing height of a traveler using the traffic area of the traffic route. As already indicated, these elements may be windows or noise barrier windows.

According to one variant of the invention, the transparent element has with preference on its side facing the traffic area of the traffic route a sound-absorbing surface, which may for example be formed as a honeycomb.

The transparent element may for example comprise polycarbonate or other plastics, such as acrylic or PMMA (polymethylmethacrylate) or glass, or be at least partly formed from plastic, polycarbonate, acrylic, PMMA or glass. Polycarbonates are synthetic polymers from the family of polyesters. Polycarbonates are able to be adjusted to make them highly transparent, suitable for coloring, welding and adhesive bonding and have high dimensional stability as well as high impact strength. Polycarbonates are known for example under the trade name MAKROLON from BAYER AG or LEXAN from the plastics division of GENERAL ELECTRIC. Polymethylmethacrylate is also known under the trade name "Plexiglas". Plexiglas and acrylic or acrylic glass are synthetic, glass-like thermoplastics.

According to variants of the invention, the transparent element may be of a multi-layered or multi-laminated design, for example in such a way that a number of transparent plates, which may be spaced apart from one another, build up a transparent element. A transparent element may in this case also have a number of transparent sub-elements that are connected to one another, the sub-elements for example forming a transparent plate.

According to one embodiment of the invention, the transparent element comprises a hollow space, which may for example be obtained by the transparent element having two transparent plates which are spaced apart from one another. With preference, the two plates of the transparent element are separated from one another by at least one web. The web or webs is or are intended in particular to achieve the effect that the two transparent plates of the transparent element are spaced apart from one another as equidistantly as possible, as far as possible over the entire extent of the transparent element. The number of webs per transparent element and their arrangement are in this case chosen with preference according to the dimensional stability of the two transparent plates of the transparent element. In the case of a multi-layered design of the transparent element, it may have hollow spaces, in particular for noise barrier. In the noise barrier design, the transparent element may also be a noise barrier window.

Embodiments of the invention provide that the transparent element, in particular the transparent element having two spaced-apart plates, is arranged with a first longitudinal edge side in a first strip, which has a U-shaped cross-sectional profile. The first strip has in this case in a limb of the U-shaped cross-sectional profile that is facing the traffic area at least one opening, with preference a number of openings, along the strip to an inner space of the first strip, which inner space is connected to the hollow space of the transparent element. With preference, the transparent element is arranged with a second longitudinal edge side, opposite from the first longitudinal edge side, in a second strip with a U-shaped or else double M-shaped cross-sectional profile, the second strip having an inner space which extends along the second strip and is connected to the hollow space of the transparent element. This configuration of a transparent element with a hollow space and the arrangement in a first and a second strip makes it possible for the opening of the first strip, the inner space of the first strip, the hollow space of the transparent element and the inner space of the second strip to form a channel, which with preference is connected to a device for supplying fresh air and/or for extracting exhaust air. If, therefore, a transparent element forms for example a wall portion of an enclosure of a traffic area in such a way with a first strip and a second strip, it is possible for the channel described to be used with preference for extracting exhaust air from the enclosure and sending it for example to a filter device. There is, however, also the possibility, as already mentioned, of using the channel for supplying fresh air into the enclosure. The device for supplying fresh air and/or extracting exhaust air has for example a system of pipes connected to the channel or to a number of such channels, which system of pipes interacts with a ventilation system for supplying fresh air and/or for extracting exhaust air.

One variant of the invention provides that at least one traffic route is assigned at least one device, with preference independently of the transparent element, for supplying fresh air into and/or extracting exhaust air out of the enclosure of the traffic route. This may be, for example, a ventilation system connected to a system of pipes, as is known for example from tunnel installations of large road tunnels for automobiles.

The enclosure, having at least one transparent element, for at least part of a traffic area of a traffic route may for example be formed as a tunnel. An enclosure may have at least two side walls, of which at least one side wall is formed at least partly by a transparent element. The enclosure may for example be formed in a V-shaped or U-shaped manner. According to one variant of the invention, the enclosure may, however, also have a separately designed roof structure, it also being possible for the roof structure to comprise at least one transparent element.

With a view to greatest possible transparency, it may be provided that the roof structure of the enclosure is constructed almost completely from transparent elements.

Furthermore, there is the possibility of the enclosure having at least one transparent element which has a longitudinal extent and is arc-shaped in cross section. With preference, two arc-shaped transparent elements are connected to one another, for example by way of a double U-shaped strip, in such a way that they form a U-shaped portion of an enclosure. Given sufficient elasticity of the material for the transparent element, it is also possible for only one transparent arc-shaped element to form a U-shaped portion of an enclosure. The arc-shaped transparent element may also have a number of transparent sub-elements, which are connected or adhesively bonded to one another for example by silicone or are connected to one another by corresponding strips, for example from the company SCHÜCO or the company SCHMIDLIN-TECHNIK.

Independently of the form of an enclosure or roof structure of an enclosure, the enclosure or roof structure may have at least one opening for air exchange and/or fire protection, for example smoke and heat extractor flaps. The opening may in this case be located at the vertex of the enclosure or the roof structure. With preference, the opening is provided on the side of the traffic installation that is facing away from the wind, in order to avoid undesired wind influences, in particular in the case of strong winds, in the enclosure. The opening in the enclosure or the roof structure is preferably at least one opening gap extending along the enclosure or the roof structure.

One embodiment of the invention provides that a traffic route has at least one groove-shaped recess and/or at least one channel and/or at least one empty tube, which may be arranged on the upper side and/or the underside of the traffic route or the traffic area of the traffic route. The recess, the channel or the empty tube are for example intended for receiving supply lines, for example electric supply lines, or for receiving electric control lines or for supplying fresh air or extracting exhaust air or for carrying liquids.

According to one variant of the invention, a traffic route has as a safety device at least one crash barrier, the crash barrier being arranged with preference on each side of a traffic area of a traffic route. If a traffic area of a traffic route is for example a roadway for automobiles and/or two-wheeled vehicles, the roadway has such a crash barrier at its edge, that is to say the edge of the traffic area. With preference, the crash barrier is a laterally stable guiding guard or stable guide along the traffic route, which is intended to prevent the means of transport from falling off, whether as a result of an accident or inattentiveness of a driver, in particular in the case of a traffic route that is arranged over another traffic route. The crash barrier may in this case be designed in the form of a guardrail or in the form of a wall and form part of the enclosure.

The crash barrier has with preference on its side facing the traffic area a sound-absorbing surface. The sound-absorbing surface may have a special surface structure with depressions (for example holes) or other sound-refracting elements. Corresponding mats or coverings, coatings or renderings may also be applied.

Furthermore, according to variants of the invention, the crash barrier may have an opening for supplying fresh air and at least one groove-shaped recess and/or at least one channel and/or at least one empty tube, for example for receiving electric supply or control lines. With preference, the recess and/or the channel and/or the empty tube of the crash barrier and/or of the traffic route are intended for receiving at least one component of a traffic control system. It is conceivable that, with such a traffic control system in the manner of an autopilot function, means of transport using the traffic route are for example controlled in such a way that the means of transport automatically travel at the correct speed and have the necessary distances from one another and to the side, such a traffic control system allowing in particular, as a result of the automatic control of the distance to the side, the traffic area to be made particularly narrow. As a result of the enclosure that is unaffected by atmospheric influences, better control guides and/or driverless systems are also possible, and these can be used just the same as escalators (for example in the roof).

According to a further variant of the invention, the at least one groove-shaped recess, the at least one channel and/or the at least one empty tube of the traffic route and/or of the crash barrier of the traffic route may be intended for receiving at least one component of an automatic transport system for a means of transport, for example a vehicle. Such a transport system may be for example a drag system or a transport system having at least one transporting belt. The drag system may be designed in such a way that a vehicle is hooked with a component of the vehicle, for example a shackle, in a hook of the drag system and the drag system automatically guides the vehicle over the traffic route. This may take place in a comparable way with one or more transporting belts for a means of transport.

According to one embodiment of the invention, the traffic area of a traffic route has at least one roadway for automobiles and/or for two-wheeled vehicles, at least one path for pedestrians and/or un-motorized two-wheeled vehicles, also serving as an emergency and escape route, or at least one rail track for rail-bound vehicles. A traffic route may in this case have only one traffic area for traffic in one direction, a number of traffic areas for traffic in one direction or a number of traffic areas for traffic in opposite directions. According to one variant of the invention, in particular the traffic areas for traffic in opposite directions of a traffic route are separated by a crash barrier.

If the traffic area is a roadway for automobiles and/or for two-wheeled vehicles and/or a path for pedestrians and/or un-motorized two-wheeled vehicles and/or a traffic area having a rail track, the roadway or traffic area has with preference a sound-absorbing surface. The sound-absorbing surface comprises for example an open-pore asphalt. The sound-absorbing surface may have a special surface structure with depressions (for example holes) or other sound-refracting elements (for example trapezoids or honeycombs). A surfacing over a traffic area may also have such a sound-absorbing surface.

According to one embodiment of the invention, the traffic installation has at least one signaling system for indicating the direction of the traffic on a traffic area of a traffic route. This is advantageous in particular whenever a traffic area of a traffic route can be used by traffic in both directions.

Moreover, joining and leaving the traffic routes takes place with preference by way of ramps, approaches, exits, elevators and/or by way of parking structures built onto the traffic routes.

According to one variant of the invention, the traffic installation has at least one emergency, escape or rescue route. Furthermore, at least one traffic route of the traffic installation may have at least one emergency, breakdown or escape bay. In particular in the case of single-lane traffic areas or roadways, such emergency, breakdown or escape bays are recommendable to allow hold-ups of the traffic flow to be avoided.

BRIEF DESCRIPTION OF THE DRAWINGS

Exemplary embodiments of the invention are represented in the accompanying schematic drawings, in which.

DETAILED DESCRIPTION OF THE PREFERRED EMBODIMENTS

Figure 1:
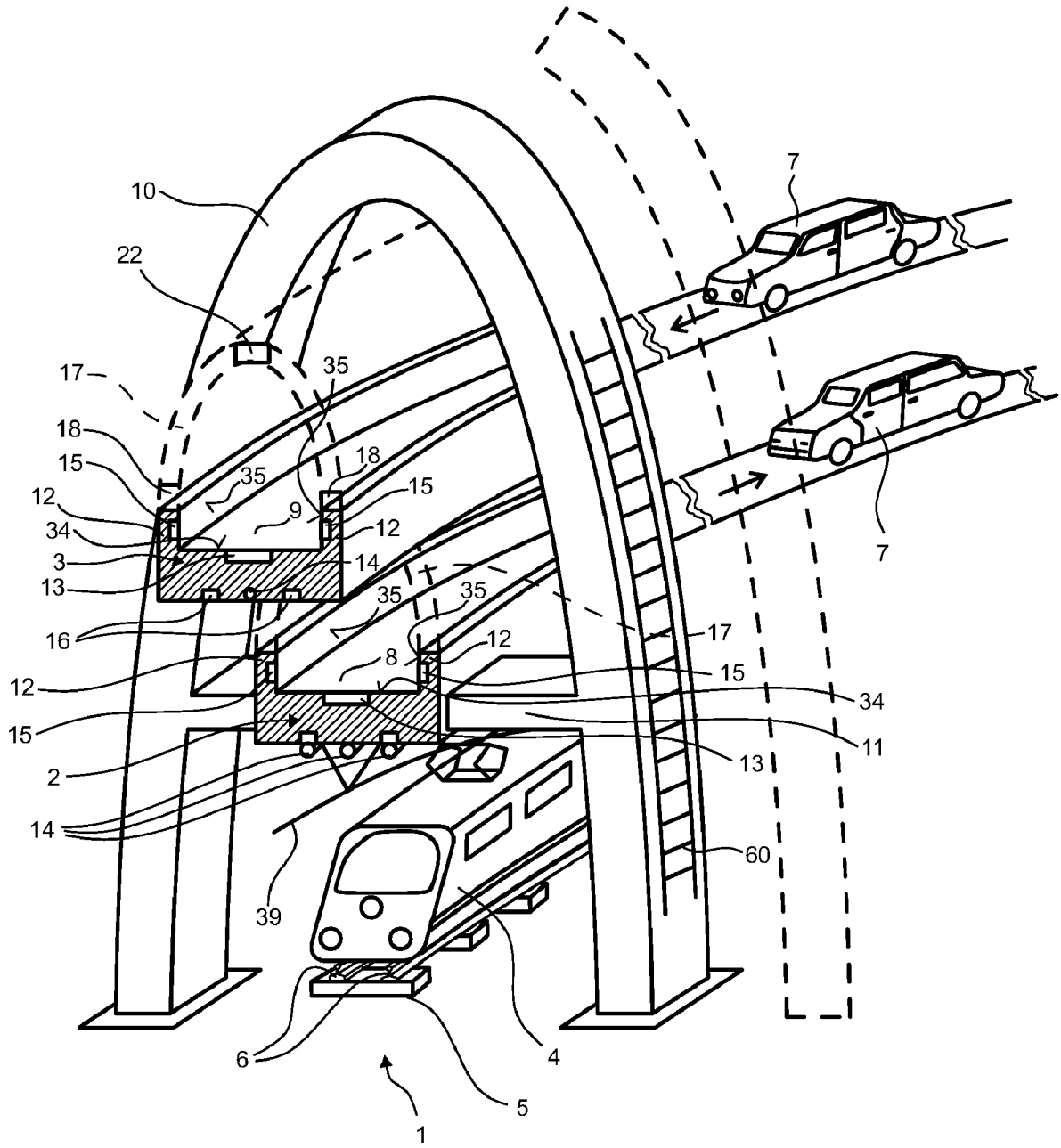
FIG. 1 shows a partial view of a traffic installation according to the invention in a partly sectional representation.

FIG. 1 shows a first exemplary embodiment of a traffic installation according to the invention, in which three traffic routes are arranged such that they follow substantially the same path, vertically one above the other, on three different levels. In the case of the present exemplary embodiment, the first traffic route 1 is intended for rail-bound vehicles, in the present case for trains 4. The traffic area 5 of the traffic route 1 has in this case two rail tracks 6 for the trains 4.

In the case of the present exemplary embodiment, the second traffic route 2 and the third traffic route 3 are traffic routes for automobiles 7 and motorized two-wheeled vehicles (not represented in FIG. 1). In the case of the present exemplary embodiment, both the traffic route 2 and the traffic route 3 each have only one traffic area in the form of a roadway 8 and 9, respectively, which is in each case intended for traffic in only one direction, as is evident from the position of the automobiles 7 and the arrows entered for this purpose.

In the case of the exemplary embodiment shown in FIG. 1, the traffic installation has a supporting structure, in particular for the traffic routes 2 and 3, which comprises a number of supporting piers. FIG. 1 shows such a supporting pier 10 of the supporting structure, which in the case of the present exemplary embodiment is formed in a U-shaped manner and has transverse struts 11 for supporting the traffic routes 2 and 3, only the transverse struts 11 for the traffic route 2 being evident in FIG. 1. The supporting structure as a whole or its supporting piers 10 may be constructed at least partly from concrete, reinforced concrete, aluminum, hybrid materials comprising plastics, GRP (glass fiber reinforced plastic), CRP (carbon fiber reinforced plastic), other plastics and also from a three-dimensional framework still to be explained later. There is in this case the possibility of combining or putting together different building materials to construct the supporting structure, in particular the supporting piers 10 of the supporting structure.

The traffic routes 2 and 3 are constructed substantially the same and, in a way not expressly represented in FIG. 1, have a number of traffic route sections, which are supported by the supporting piers 10 of the supporting structure. In the case of the present exemplary embodiment, the sections of the traffic routes 2 and 3 are formed from reinforced concrete and have in each case on both sides of the roadway 8 or 9 a crash barrier 12 in the form of a wall 12. In particular in the case of an accident involving a vehicle 7, whether caused by a collision of the vehicle 7 with another vehicle 7 or by inattentiveness of the vehicle driver, the crash barrier 12 is intended to prevent the vehicle 7 from falling from the traffic routes 2 or 3.

In the case of the present exemplary embodiment, the traffic routes 2 and 3 have groove-shaped recesses, channels and empty tubes, which may serve for receiving supply lines, for example electric supply lines, electric control lines, extraction devices, transporting devices, etc. In the case of the traffic route 2, it has on the upper side of the roadway 8 a groove-shaped recess 13 extending along the roadway 8 and on its underside three empty tubes 14. The crash barrier 12 on both sides of the roadway 8 of the traffic route 2 has in each case on its side facing the roadway 8 a channel 15 extending along the traffic route 2. In the case of the present exemplary embodiment, the recess 13 and the channels 15 are covered.

In a way comparable to the traffic route 2, the traffic route 3 also has in the case of the present exemplary embodiment a groove-shaped recess 13 on its upper side of the roadway 9 and an empty tube 14 and two groove-shaped recesses 16 on its underside. As in the case of the traffic route 2, the crash barriers 12 on both sides of the roadway 9 of the traffic route 3 in each case have a channel 15.

The recesses 13 and 16 as well as the empty tube 14 and the channels 15 extend in turn at least over a partial region along the traffic routes 3. In the case of the present exemplary embodiment, the recesses 13 and 16 as well as the channels 15 of the traffic route 3 are in turn covered.

The roadways 8 and 9 as well as the crash barriers 12 arranged to the sides of the roadways 8 and 9, in particular the surfaces of the crash barriers 12 that are facing the roadways 8 and 9, each have in the case of the present exemplary embodiment a sound-absorbing surface 34 and 35, respectively. These may be rough surfaces or surfaces having sound-refracting elements, with depressions, holes, etc. They may, however, also be sound-insulating coverings, mats, coatings, renderings, etc.

In the case of the exemplary embodiment shown in FIG. 1, both the traffic route 2 and the traffic route 3 are completely enclosed simultaneously over a certain section of the route. In the case of the present exemplary embodiment, the tunnel-shaped enclosures 17 of the traffic routes 2 and 3 are formed substantially the same, for which reason reference will only be made hereafter to the enclosure 17 of the traffic route 3.

Figure 2:
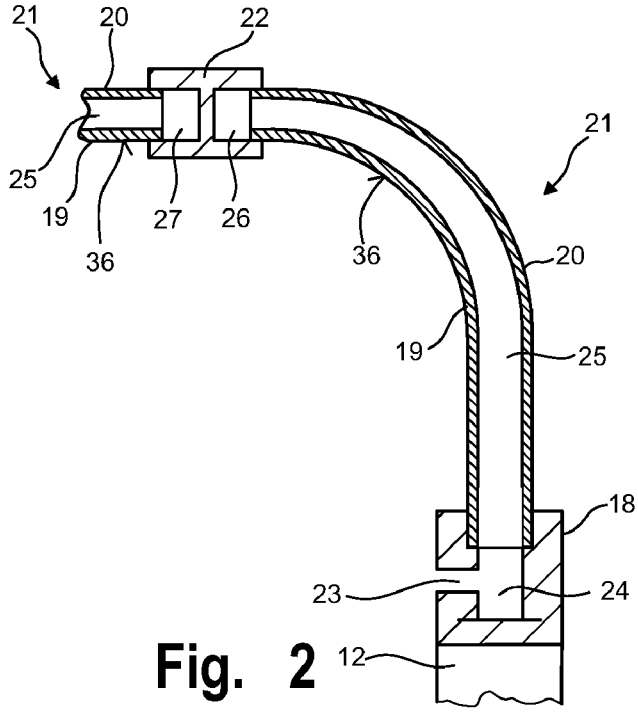
FIG. 2 shows a detail of a section through an enclosure of the traffic installation from FIG. 1.

FIG. 2 shows a detail of a section through the enclosure 17 of the traffic route 3, which has been taken transversely in relation to the longitudinal extent of the enclosure 17. It can be seen from FIGS. 1 and 2 that, in the case of the present exemplary embodiment, the enclosure 17 is made up of a number of components. The enclosure 17 in this case comprises on both sides of the roadway 9 strips 18, which are arranged in each case on a crash barrier 12, extend along the traffic route 3 and, as can be seen from FIG. 2, have a U-shaped cross-sectional profile. The traffic route 3 generally has a number of such strips 18, which, as already mentioned, respectively extend along the traffic route 3. In the case of the present exemplary embodiment, transparent plates 19 and 20, which have a longitudinal extent in the direction of the traffic route 3 and with preference are spaced apart equidistantly from one another, are arranged in a strip 18. The plates 19, 20, which with preference are connected to one another at certain intervals by way of webs 28 (cf. FIG. 3), thereby form a hollow space 25. The plates 19 and 20 as well as the webs 28 connecting them are in this case a component part of a transparent element 21, which, as already mentioned, is arranged with a side longitudinal edge in the strip 18. The enclosure 17 of the traffic installation generally has a number of such transparent elements 21, which extend in a row in the direction of the traffic route 3. In the case of the present exemplary embodiment, the other side longitudinal edge of the transparent element 21 is arranged in a second strip 22, which in the case of the present exemplary embodiment has a double U-shaped cross-sectional profile and serves as a connecting link between two transparent elements 21, which together with the strips 18 and 22 form a subportion of the enclosure 17.

Figure 3:
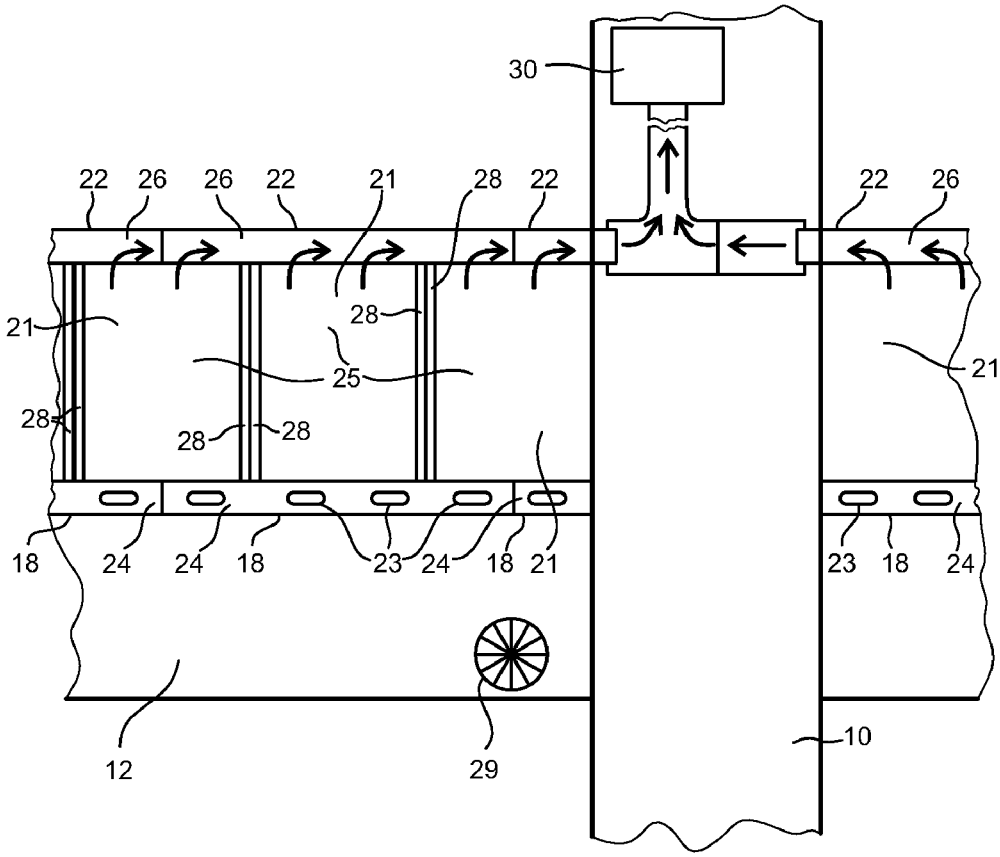
FIG. 3 shows a detail of an inner view of an enclosure from FIG. 1 in a partly sectional representation.

The strip 18 generally has along its extent along the traffic route 3 a number of openings, one opening 23 of which is shown by way of example in FIG. 2. The opening 23 leads to an inner space 24 of the strip 18, which extends along the strip 18. The inner space 24 of the strip 18 and the hollow space 25 of the transparent elements 21 are in this case connected to one another in such a way that an exchange of media is possible. Moreover, the strip 22 likewise has an inner space 26 and 27, which inner spaces 26, 27 extend along the strip 22 or the traffic route 3. The opening 23 and the inner space 24 of the strip 18, the hollow space 25 of the transparent element 21 and the inner space 26 of the strip 22 in this case form a channel that can be used for supplying fresh air into the inner space of the traffic route 3 and/or for extracting exhaust air from the inner space of the traffic route 3. In FIG. 3, the principle of the extraction of exhaust air by means of the channel described is shown in a schematic inner view, that is to say a view from the traffic route 3 in the outward direction. Exhaust air can be sucked into the inner space 24 of the strip 18 by way of the openings 23, and is extracted through the hollow space 25 of the transparent element 21 and the inner space 26 of the strip 22. As shown in FIG. 3, for this purpose there are, for example in the supporting piers 10 of the traffic installation, corresponding extraction devices, which are connected to the strips 22. Such an extraction unit 30, which may for example include a fan, is schematically represented by way of example in FIG. 3. As can be seen from FIG. 3, with the aid of the extraction unit 30, exhaust air can be extracted from the inner space of the traffic route 3 on both sides of the supporting pier 10. Moreover, FIG. 3 also shows webs 28, which, as already mentioned, connect the plates 19 and 20 of a transparent element 21 equidistantly to one another. As can be seen from FIG. 3, the enclosure 17 generally has a number of strips 18, 22 and a number of transparent elements 21.

Furthermore, it can be seen from FIG. 3 that, in the case of the present exemplary embodiment, the crash barrier 12 may have openings for supplying fresh air into the inner space of the traffic route 3. Such an opening 29 is shown by way of example in FIG. 3.

In the case of the present exemplary embodiment, the strips 18 and 22 are formed with preference from a corrosion-resistant metal, plastic or coated metal alloy. The transparent plates 19 and 20 of the transparent element 21 are for example formed from fully transparent polycarbonate. In the case of the present exemplary embodiment, the surface 36 of the transparent plate 19 of a transparent element 21 that is facing the inner space of the traffic route 3 is formed in a sound-absorbing manner, which does not necessarily have to be the case. The sound-absorbing form of this surface 36 of the transparent element 21 and of the roadway 9 and of the surfaces of the crash barriers 12 does not cause the enclosure 17 of the roadway 9 to produce increased noise for travelers using the traffic route 3.

As an alternative or additional measure for providing protection from noise, double walls may be provided for the enclosure 17 or parts of the enclosure 17 or any other enclosure.

In the case of the present exemplary embodiment, the transparent element 21 with the plates 19, 20 is formed in an arc-shaped manner. However, given sufficient elasticity of the plates 19 and 20, they do not have to be formed in an arc-shaped manner but may be of a planar form, and then bent appropriately to allow them to be arranged in the strips 18 and 19.

The transparent element 21 may, moreover, also be constructed in a multi-layered manner, i.e., in particular to provide protection from noise to the outside, the transparent element 21 may have further transparent plates, which are arranged between the plates 19 and 20. However, the transparent element 21 does not necessarily have to have two or more transparent plates, but may also be formed just from a single transparent plate or a number of transparent plates connected directly to one another, between which there is no hollow space. In this case, in particular if it comprises only one transparent plate or a number of transparent plates connected directly to one another, the transparent element may be formed in an arc-shaped manner as one part.

As already mentioned at the beginning, the complete enclosure of the roadway 9 or 8 of the traffic route 2 or 3, at least over part of its length, on the one hand produces a noise barrier for the surroundings of the traffic installation, on the other hand means that exhaust gases in the exhaust air do not escape unhindered into the environment, but can for example be cleaned by means of the extraction unit 30, using corresponding filters. In addition, the traffic routes 2 and 3 are subject to less corrosion and the risk of accidents, in particular at the colder time of year bringing snow and ice, is also reduced. As a result of the arrangement of a number of traffic routes one above the other, a considerable saving is obtained in the resource of land, additionally allowing synergies to be exploited. For example, in the case of the exemplary embodiment shown in FIG. 1, the electricity of the upper line 39 of the traffic route 1 can be used for lighting the traffic routes of the traffic installation or for other electrically operated devices of the traffic installation, for example signaling systems such as traffic lights and traffic direction indicators.

Figure 4:
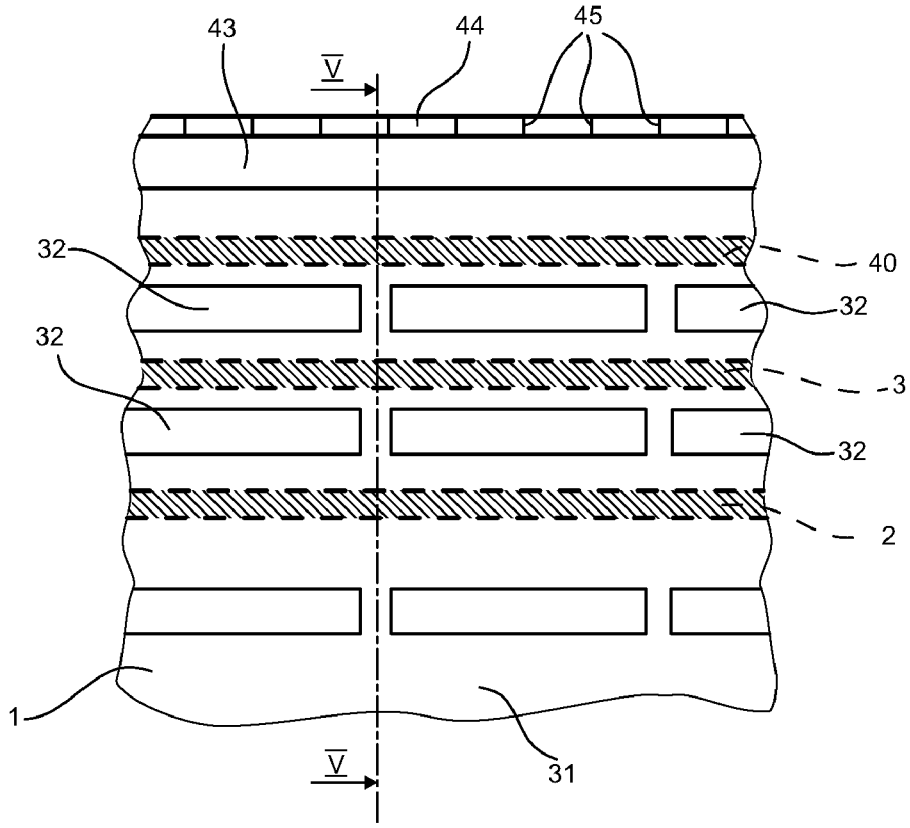
FIG. 4 shows a detail of another embodiment of a traffic installation.
Figure 5:
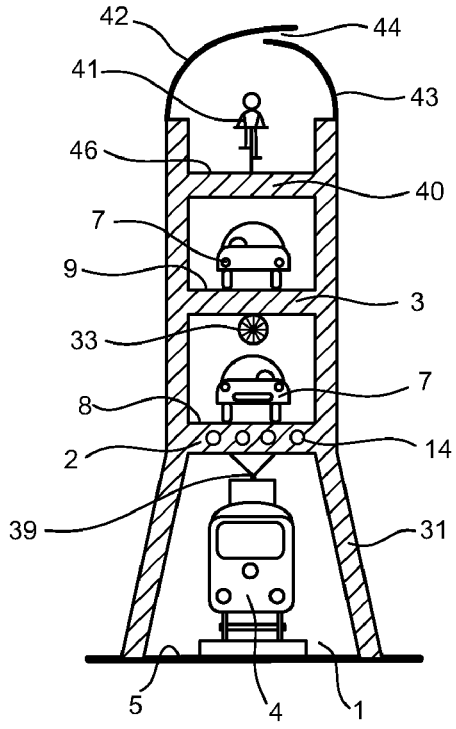
FIG. 5 shows a sectional view in the direction of the arrows V from FIG. 4 and FIGS. 6 to 9 show further exemplary embodiments of traffic installations according to the invention.

FIGS. 4 and 5 show a second exemplary embodiment of a traffic installation as a detail and in a sectional representation in the direction of the arrows V from FIG. 4. The exemplary embodiment represented in FIGS. 4 and 5 differs from the exemplary embodiment shown in FIGS. 1 to 3 substantially in that the supporting structure 31 in the case of the exemplary embodiment represented in FIGS. 4 and 5 completely encloses the traffic routes 1 to 3, at least over a certain section of the traffic routes 1 to 3. As already mentioned, the supporting structure 31 may in this case be constructed from concrete, reinforced concrete, hybrid materials comprising plastics or from other materials. To allow travelers using the traffic routes 1 to 3 to have an unrestricted view out of the supporting structure 31 to avoid claustrophobic feelings or to avoid feelings of being confined, the traffic installation represented in FIGS. 4 and 5 has on both sides of the roadways 8 and 9 and on both sides of the rail track of the traffic routes 1 window-like transparent elements 32, which are arranged at least at the viewing height or eye level of a traveler using the roadways 8 and 9 of the traffic routes 2 and 3 or the traffic route 1, as can be seen from FIG. 4. The window-like transparent elements 32 may in this case also be arranged directly next to one another, with the result that no intermediate spaces remain between them, as shown in FIG. 4. In the case of the exemplary embodiment shown in FIGS. 4 and 5, the crash barrier is formed by the wall portion of the supporting structure 31 under the window-like transparent elements 32.

As in the case of the exemplary embodiment that is shown in FIGS. 1 to 3, the roadways 8 and 9, the crash barriers and the window-like transparent elements 32 in the case of the exemplary embodiment shown in FIGS. 4 and 5 also have a sound-absorbing surface on their side facing the inner space of the traffic routes 1 to 3, which does not necessarily have to be the case. Rather, the window-like transparent elements 32 may also be formed as conventional windows or as noise barrier windows. In addition, the traffic installation shown in FIGS. 4 and 5 may also include the functional elements or functional components that are described in conjunction with the traffic installation that is shown in FIGS. 1 and 3. For example, FIG. 5 shows for the traffic route 2 the provision of empty tubes, which in turn extend along the traffic route 2. However, the traffic routes may also have channels and/or recesses. It is additionally indicated in FIG. 5 that an enclosed traffic route may be assigned a device for supplying fresh air and/or for extracting exhaust air that is preferably independent of the transparent element and the extraction channel thereof. FIG. 5 shows in the case of the present exemplary embodiment an extraction device 33, which may for example have a fan. In a way not represented in FIG. 5, the extraction device 33 may comprise a system of pipes, with which the exhaust air can be discharged to the surroundings, possibly after prior filtering. The exhaust air may, however, also be discharged to the environment without filtering in areas that are not critical for humans.

The exemplary embodiment of a traffic installation that is shown in FIGS. 4 and 5 additionally has a fourth traffic route 40, which is arranged above the traffic route 3 and, in the case of the present exemplary embodiment, is intended for pedestrians and un-motorized two-wheeled vehicles, for example bicycles 41. At least over a partial region, the traffic route 40 or the traffic area 46 thereof is completely enclosed, in the case of the present exemplary embodiment by arc-shaped transparent elements 42, 43. The arc-shaped transparent elements 42 and 43 are in this case arranged in relation to one another, or arranged on the supporting structure 31, in such a way that the enclosure has an opening, which in the case of the present exemplary embodiment is an opening gap 44 extending along the enclosure. The arc-shaped transparent elements 42, 43 are in this case kept at a substantially constant distance from one another, with preference by webs 45, to form the opening gap 44. The opening gap 44, which with preference is facing the side of the traffic installation that is away from the wind, makes it possible for fresh air to flow into the traffic route 40. There is also the possibility on the one hand of supplying fresh air to a traffic route by way of openings 29 that are arranged with preference in a crash barrier (cf. FIG. 3), or by way of an opening gap 44, shown in FIG. 5. In particular when openings 29 are used, they may be connected to a device which blows the fresh air specifically into the inner space of the traffic routes.

Further exemplary embodiments of traffic installations according to the invention are shown in FIGS. 6, 7, 8 and 9.

Figure 6:
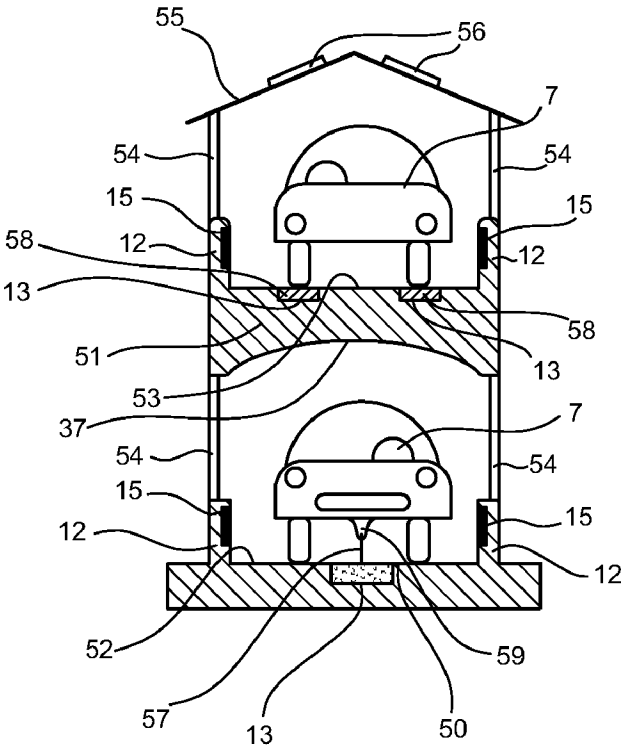

The traffic routes 50, 51 of FIG. 6 with their roadway 52 or 53, respectively, in particular for automobiles 7, correspond substantially to the traffic routes 2 and 3 of the exemplary embodiment described above. The traffic routes 50, 51 have on both sides of the roadway 52 or 53, respectively, in each case a crash barrier 12. In the case of the exemplary embodiment shown in FIG. 6, the supporting piers, which support in particular the traffic route 51, cannot be seen. Between the crash barriers 12 of the traffic route 50 and the traffic route 51, window-like transparent elements 54 extend on both sides along the traffic route 50, whereby the traffic route 50 or the roadway 52 of the traffic route 50 is completely enclosed, at least over a certain section. The window-like transparent elements 54 may in this case be, for example, conventional windows or noise barrier windows. The traffic route 51 in this case represents a kind of roof structure or ceiling 37 for the traffic route 50. The ceiling 37 may in this case have a sound-absorbing surface. The sound-absorbing surface of the ceiling 37 may be formed in the same way as the surface 34 or 35.

The traffic route 51 is enclosed in a comparable way, the traffic route 51 having in addition to the laterally arranged window-like transparent elements 54 a roof structure 55, which may likewise be constructed from transparent elements or other roof elements. The roof structure 55 may have openings 56 for leading away the exhaust gases or for supplying fresh air. The roof structure may, however, also be assigned an extraction device, with which the exhaust air or the exhaust gases are sent to a filter system or, in areas that are not critical to man, are discharged into the environment.

The exemplary embodiment shown in FIG. 6 discloses in particular a possible use of the aforementioned groove-shaped recesses, channels or empty tubes of the traffic routes or the crash barriers of the traffic routes. For example, the channels 15 of the crash barriers 12 of the traffic routes 50 and 51 serve for receiving at least one component of a traffic control system. Such a traffic control system may for example have a kind of autopilot function, with the result that vehicles 7 using the traffic routes 50 and 51 and having appropriate electrical devices communicating with the traffic control system can for example be automatically controlled. The control may for example comprise that the vehicles are given a prescribed speed or a certain distance from the vehicle ahead or from the crash barriers 12, with the result in particular that the roadways 52 and 53 of the traffic routes 50 and 51 can be made particularly narrow.

Furthermore, FIG. 6 shows that a component 57 of an automatic transport system for vehicles 7 may be arranged in the recess 13 of the roadway 52. In the case of the exemplary embodiment shown in FIG. 6, the transport system is an automatic drag system, a hook 57 of the drag system in each case engaging in a corresponding counter-device, for example a shackle 59, of a correspondingly equipped vehicle 7 and automatically transporting the vehicle 7 over the traffic route 50.

In each recess 13 of the traffic route 51, in the case of the present exemplary embodiment a transporting belt 58 is arranged in each case, which likewise has the effect that a vehicle 7 is automatically guided over the traffic route 51 with the aid of the transporting belts 58. With the aid of such transport systems, there is no need for the vehicles 7 to drive themselves on the traffic routes 50, 51.

If one of the traffic routes 50, 51 has a traffic control system and/or an automatic transport system, they comprise, in a way not represented, at least one control device in the form of a program-controlled computing device. The control device of the traffic control system in this case controls the vehicle guidance over the respective traffic route and the control device of the automatic transport system controls the transporting of the vehicles over the respective traffic route.

In the exemplary embodiments described so far, a traffic route has in each case only one traffic area or roadway for traffic in one direction. According to the exemplary embodiments that are shown in FIGS. 7 and 8, however, a traffic route may also have a number of traffic areas for traffic in one direction or traffic in opposite directions.

Figure 7:
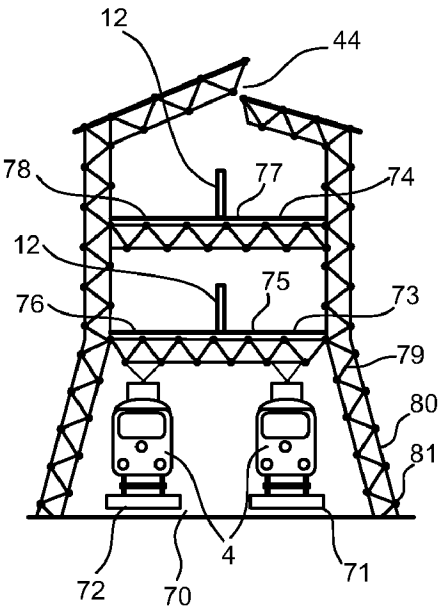

In the case of the exemplary embodiment shown in FIG. 7, the traffic route 70 has two traffic areas 71 and 72 for trains 4. The traffic routes 73 and 74, which are arranged above the traffic route 70, likewise have in each case two traffic areas 75, 76 and 77, 78, respectively, which are in each case separated from one another by a crash barrier 12. In the case of the exemplary embodiment represented in FIG. 7, the supporting structure 79 is designed as a three-dimensional framework with tubes 80 and connecting elements 81. The tubes 80 are connected to one another by way of the connecting elements or connecting nodes 81 in such a way that the supporting structure in the form of the three-dimensional framework 79 is obtained. The traffic routes 73 and 74 are in this case completely enclosed, at least over one section, in a way that cannot be seen from FIG. 7 by the three-dimensional framework, which for this purpose may be covered for example with plates on the inside and/or on the outside. To ensure an unrestricted view for a traveler using the traffic routes 73 and 74, they have, likewise in a way that cannot be seen from FIG. 7, corresponding window-like transparent elements arranged in the three-dimensional framework 79, as are represented for example in FIG. 4.

Figure 8:
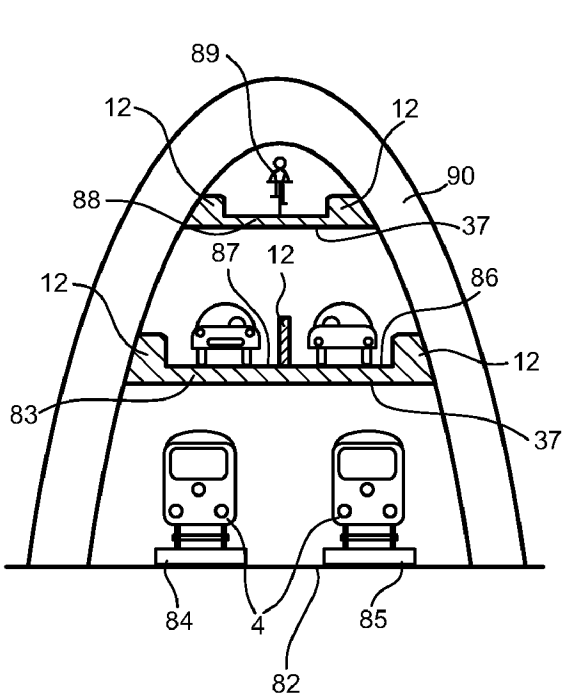

FIG. 8 shows an exemplary embodiment of a traffic installation in which, in particular, the traffic routes 82 and 83 have in each case two traffic areas. The traffic areas 84 and 85 are in turn intended for trains 4, while the traffic areas 86 and 87 of the traffic route 83 are intended for automobiles. The traffic route 88 is intended for use by pedestrians 89 or vehicle drivers. As in the case of the exemplary embodiment shown in FIGS. 4 and 5, the traffic routes 82, 83 and 88 are completely enclosed by a supporting structure 90 over at least a section of their extent. As previously described, the traffic routes are in this case assigned window-like transparent elements.

In particular in the case of the exemplary embodiments shown in FIGS. 7 and 8, the traffic installation may have signaling systems which are assigned to the traffic areas of the traffic routes and with which for example the direction of the traffic can be indicated if traffic areas are intended to be used optionally for traffic in two directions. Accordingly, the signaling systems or traffic direction indicators can be used to adapt the traveling direction of the vehicles to the respective traffic situation.

In this respect there is also the possibility of allowing the traffic areas of a traffic route to be used by vehicles of a different type. For example, a traffic route may have a traffic area for automobiles and, alongside it, a traffic area for trains.

Moreover, joining and leaving the traffic routes takes place in a way not represented in the figures, with preference by way of ramps, approaches, exits, elevators for the vehicles or else by way of built-on parking structures.

In a way not represented, the enclosures of the traffic routes may have emergency exits for emergency situations. FIG. 1 shows by way of example an escape ladder 60, which is arranged on the supporting pier 10 and by way of which the traffic routes 2 and 3 can be left in an emergency. Such an emergency, escape or rescue route may also be enclosed, as indicated in FIG. 1 by dashed lines. There may, however, also be a kind of roof structure provided for the emergency, escape or rescue route. The emergency, escape or rescue route may in this case also be formed in a different manner, for example have stairs with or without a stairwell.

Furthermore, the traffic installation may have at least one element which is assigned to the traffic route, is arranged inside the enclosure of the traffic route and is intended for separating the flow of noise and/or wind and/or separating the flow of exhaust gases, clouds of smoke, etc. The element may for example be arranged on the enclosure and/or on a crash barrier and extend right angles or some other angle in the direction of the traffic area of the traffic route, the element having a vertical longitudinal extent and a widthwise extent, in the direction of the traffic area. The widthwise extent is, however, such that the traffic over the traffic area is not hindered. The element may in this case be a spoiler or be constructed like a spoiler and have a separating edge and/or trapezoidal contour and/or some other suitable inner contour to disturb a flow or an air flow in a way comparable to a spoiler. A traffic route generally has a number of such elements, which may be arranged on one or two sides of a traffic area, roadway, etc. The elements or spoilers serve in particular the purpose of at least partly preventing or hindering a suction effect, which may occur within the housing, for example as a result of vehicle movements. Separating edges of the elements or spoilers in this case provide separation of the flow of wind or air flow. The elements can also be used to separate the flow of noise, and to separate the flow of streams of exhaust gases or clouds of smoke, etc. With preference, the element or the spoiler is in this case respectively adapted to the enclosure. An element or spoiler may accordingly be formed in such a manner that it is rectangular, flat or arc-shaped, flat or triangular, flat, etc.

The traffic installations described above only represent exemplary embodiments of the invention. For example, a traffic route for rail-bound vehicles may also be arranged above a traffic route for automobiles or pedestrians. Depending on the situation, traffic routes for different means of transport can therefore be arranged in various combination one above the other.

The transparent element also does not necessarily have to be formed from polycarbonate, but may also be formed from glass, acrylic or PMMA (polymethylmethacrylate), and with or without protection from noise.

In particular whenever a traffic route has only one roadway, lane, etc., it is recommendable to provide escape, emergency or breakdown bays at certain intervals along the traffic route. However, traffic routes with a number of roadways, lanes, etc. may also have such escape, emergency or breakdown bays.

Furthermore, any mixed forms, including of the exemplary embodiments described, are possible.

Figure 9:
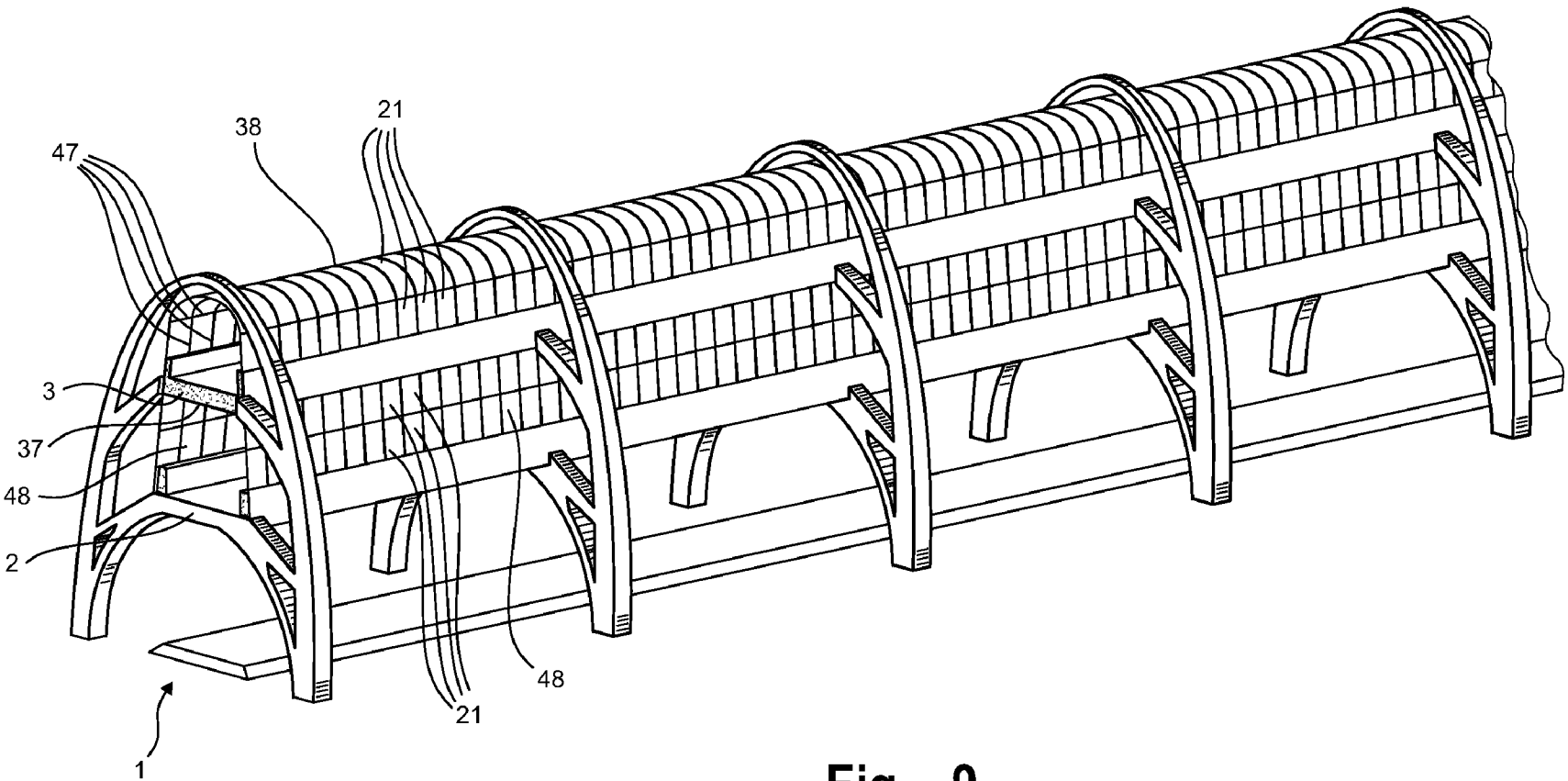

For example, FIG. 9 shows a kind of mixed form between the exemplary embodiments shown in FIG. 1 and in FIG. 6. Like the traffic installation of FIG. 1, the traffic installation of FIG. 9 has three traffic routes 1 to 3. As a difference from the exemplary embodiment represented in FIG. 1, however, the traffic route 2 is not enclosed in an arc-shaped manner in the same way as the traffic route 3, but like the traffic route 50 of the exemplary embodiment represented in FIG. 6 has transparent elements at the sides, the underside of the traffic route 3 of FIG. 9 serving as ceiling 37.

In the case of the exemplary embodiment represented in FIG. 9, a number of transparent elements 21 for forming a transparent enclosure 38 are for example adhesively bonded to one another, for example with silicone, or connected to one another by way of corresponding strips 47. In the same way, the walls 48 of the traffic route 2 may be constructed from transparent elements 21. A transparent element 21 may in this case itself be constructed in the same way, not shown in the figures, from a number of transparent sub-elements.

The traffic installation according to the invention is in this case intended not only for new structures but also for existing traffic routes. In this case there is the possibility of integrating existing traffic routes, whether for example railroad lines or roads, into the traffic installation or supplementing them with the traffic installation. Thus it is possible with the aid of a supporting structure to arrange further traffic routes over an existing traffic route. For example it is possible to arrange further traffic routes, for example for automobiles, over an existing railroad line, as represented in FIGS. 1, 5, 7 and 8. In this case it is possible for example for individual enclosures to be provided for the traffic routes, or else for the supporting structure to enclose the traffic routes.

Moreover, not all the traffic routes of a traffic installation have to be enclosed. With preference, traffic routes that are used by vehicles which produce noise and exhaust when they are operated are enclosed. For example, it is possible to dispense with the enclosure of a railroad line if the trains running on it are driven for the most part by electric motors (cf. FIG. 1).

LIST OF DESIGNATIONS

1 to 3 traffic routes
4 train
5 traffic area
6 rail track
7 automobile or vehicle
8, 9 roadway
10 supporting pier
11 transverse strut
12 crash barrier
13 recess
14 empty tube
15 channel
16 recess
17 enclosure
18 strip
19, 20 transparent plate
21 transparent element
22 strip
23 opening
24 inner space
25 hollow space
26, 27 inner space
28 web
29 opening
30 extraction unit
31 supporting structure
32 window-like transparent element
33 extraction device
34 sound-absorbing surface of the roadway
35 sound-absorbing surface of the crash barrier
36 sound-absorbing surface of the transparent element
37 ceiling
38 enclosure
39 upper line
40 traffic route
41 bicycle
42, 43 arc-shaped transparent element
44 opening gap
45 web
46 traffic area
47 strip
48 wall
50, 51 traffic route
52, 53 roadway
54 transparent element
55 roof structure
56 opening
57 hook of the track device
58 transporting belts
59 shackle
60 escape ladder
70 traffic route
71, 72 traffic area
73, 74 traffic route
75 to 78 traffic areas
79 three-dimensional framework
80 tube
81 connecting element
82 traffic route
83 traffic route
84, 85 traffic areas
88 traffic route
89 pedestrians
90 supporting structure

I claim:

1. A traffic installation, having
a) at least two traffic routes arranged one above the other,
b) which each comprise at least one traffic area,
c) which traffic area is completely enclosed at least over a certain length,
d) the enclosure having at least one transparent element allowing a view out of the enclosure
characterized
e) in that at least one traffic route is assigned at least one device for supplying fresh air and/or for extracting exhaust air,
f) in that the transparent element of the enclosure of the traffic area of this traffic route has two spaced-apart, transparent plates, between which at least one hollow space is formed,
g) in that the transparent element is arranged with a first side in a first strip with a U-shaped cross-sectional profile,
h) the first strip having in a limb of the U-shaped cross-sectional profile that is facing the traffic area at least one opening to an inner space of the first strip that is connected to the hollow space of the transparent element,
i) in that the transparent element is arranged with a second side in a second strip with a U-shaped or double U-shaped cross-sectional profile,
j) the second strip having an inner space, which extends along the second strip and is connected to the hollow space of the transparent element,
k) the opening of the first strip, the inner space of the first strip, the hollow space of the transparent element and the inner space of the second strip forming a channel,
l) the channel being connected to the device for supplying fresh air and/or for extracting exhaust air.

2. The traffic installation as claimed in claim 1, which has a supporting structure for the traffic routes.

3. The traffic installation as claimed in one of in claim 2, in which the supporting structure is formed in such a way that it completely encloses at least one traffic area of a traffic route, at least over a certain length.

4. The traffic installation as claimed in claim 1, in which the transparent element is formed like a window or like a noise barrier window and is fitted into the supporting structure like a window or a noise barrier window, a traffic route comprising at least one window-like or noise barrier window-like element at least at the viewing height of a traveler using the traffic area of the traffic route.

5. The traffic installation as claimed in claim 1, in which the transparent element has at least on the side facing the traffic area of the traffic route a sound-absorbing surface, in particular a surface formed as a honeycomb.

6. The traffic installation as claimed in claim 1, in which the plates of the transparent element are separated by at least one web.

7. The traffic installation as claimed in claim 1, in which the enclosure is formed as a tunnel.

8. The traffic installation as claimed in claim 1, in which the enclosure has at least two side walls, at least one side wall being formed at least partly by a transparent element.

9. The traffic installation as claimed in claim 1, in which the enclosure has a roof structure.

10. The traffic installation as claimed in claim 9, in which the roof structure comprises at least one transparent element.

11. The traffic installation as claimed in claim 1, in which the enclosure has at least one transparent element, which comprises a longitudinal extent and is arc-shaped in cross section.

12. The traffic installation as claimed in claim 9, in which two arc-shaped, transparent elements form a portion of the enclosure.

13. The traffic installation as claimed in claim 1, in which the enclosure has at least one opening for air exchange and/or fire protection.

14. The traffic installation as claimed in claim 1, in which a traffic route has at least one crash barrier.

15. The traffic installation as claimed in claim 14, in which the crash barrier has on its side facing the traffic area a sound-absorbing surface.

16. The traffic installation as claimed in claim 14, in which the crash barrier has at least one recess and/or at least one channel and/or at least one empty tube.

17. The traffic installation as claimed in claim 14, in which the at least one recess and/or the at least one channel and/or the at least one empty tube of the traffic route and/or of the crash barrier are intended for receiving at least one component of a traffic control system.

18. The traffic installation as claimed in claim 14, in which the at least one recess and/or the at least one channel and/or the at least one empty tube of the traffic route and/or of the crash barrier are intended for receiving at least one component of an automatic transport system for a means of transport.

19. The traffic installation as claimed in claim 1, which has at least one element which is assigned to the traffic route, is arranged inside the enclosure of the traffic route and is intended for separating the flow of noise and/or wind and/or separating the flow of exhaust gases, clouds of smoke, etc.

* * * * *